US005356106A

United States Patent [19]

Trotta et al.

[11] Patent Number: 5,356,106

[45] Date of Patent: Oct. 18, 1994

[54] UNIVERSAL DISPLAY MOUNT

[75] Inventors: Frank A. Trotta, Maplewood; Vincent J. Gamello, Hackensack, both of N.J.

[73] Assignee: Intermark Corp., South Kearny, N.J.

[21] Appl. No.: 87,580

[22] Filed: Jul. 6, 1993

[51] Int. Cl.[5] ..... E04G 3/08

[52] U.S. Cl. ..... 248/243; 108/108; 248/250

[58] Field of Search ..... 248/235, 239, 240, 241, 248/242, 243, 244, 247, 248, 250, 220.3; 108/108

[56] References Cited

U.S. PATENT DOCUMENTS

| | | | |
|---|---|---|---|
| 1,313,113 | 8/1919 | Pleister | 248/903 X |
| 1,702,937 | 2/1929 | Freidemann | 248/243 |
| 2,653,783 | 9/1953 | Lindsay | 248/243 |
| 2,741,449 | 4/1956 | Heselov | 248/243 |
| 3,114,531 | 12/1963 | Weber | 248/242 |
| 3,538,860 | 11/1970 | Fisher | 248/242 X |
| 3,729,161 | 4/1973 | Christensen | 248/242 |
| 4,008,873 | 2/1977 | Travaglio et al. | 248/242 |
| 4,615,448 | 10/1986 | Johnstonbaugh | 248/220.3 X |
| 4,938,442 | 7/1990 | Mastrodicasa | 248/242 X |
| 5,138,803 | 8/1992 | Grossen | 248/220.3 X |
| 5,185,971 | 2/1993 | Johnson, Jr. | 248/243 X |

*Primary Examiner*—Ramon O. Ramirez

*Attorney, Agent, or Firm*—Hedman, Gibson & Costigan

[57] ABSTRACT

A universal mounting bracket and assembly for use with a variety of display fixtures having slots for hanging brackets or displays including a hook member for insertion into a slot of the display fixture and adjustable leveling means for proper alignment of a display item or component.

23 Claims, 6 Drawing Sheets

UNIVERSAL DISPLAY MOUNT

FIELD OF THE INVENTION present invention relates to the field of merchandise display fixtures and, more specifically, to universal mounting means for attaching shelves, hooks or other devices to display fixtures manufactured by a variety of manufacturers.

BACKGROUND OF THE INVENTION

Gondola display fixtures and the like are widely used in retail sales as fixtures which can be adjusted to retain a variety of display components such as hooks, shelves, etc., thereby providing a flexible display environment. Flexibility provided by such display fixtures is important where maximizing shelf space is a much desired goal in retailing, to offer a customer the most choices in a limited space.

Gondola display fixtures have standard features such as a base which extends outwardly from the front of the fixture, vertical posts which rise up from the base and a pegboard between the vertical posts. The vertical posts are generally made of steel, are uniformly spaced 48" apart at the outer edges and have vertical slots in the faces to accept mounting brackets.

However, there some 30 or more manufacturers of gondola display fixtures producing fixtures having, inter alia, vertical posts of a varied array of material specifications and slots.

More prominent examples of gondola display fixtures are those manufactured by LOZIER, SCHULTZ, MADIX, HANDY, CHILDS and STREATER, to name a few. Variations in the different manufacturers posts include the width and height of the slots, the vertical distance between adjacent slots, the lateral distance between corresponding slots on opposed vertical posts, i.e. placement of the slots on the outer, middle, or inner portion of the face of the vertical posts, and the thickness of the metal used to form the vertical posts.

As such, a product promoter with a heavy or unique display component would either have to mount the component on a standard holder, i.e., shelf or hooks, having been made specifically for the particular display fixture, or make available an inventory of distinct brackets to accommodate the different display fixtures.

One attempt by applicants to adapt a component to display fixtures of different manufacturers included making an inventory of different brackets needed for the particular display fixtures available. The stores were provided with a template as shown in FIG. 1 to match up with the slots of the particular display fixture they used to determine the manufacturer of the fixture and, hence, the bracket needed. Once determined, the proper brackets would be shipped corresponding to the display fixture being used by the store.

This, however, has not been found to be entirely satisfactory where an inventory of at least 12 different brackets was being kept and the customer had to receive and use a template to determine and order the specific bracket needed. Obviously, the process was expensive, time consuming, and subject to human error.

It is therefore an object of the present invention to provide a universal display mount which can be used with most if not all of the gondola display fixtures currently being used by retailers.

It is a further object of this invention to provide such a mount which can be used to mount a variety of display components, i.e., shelves, hooks, brackets, promotional devices, etc.

Another object is to provide a universal mount which will avoid the use of the relatively weak pegboard so that heavy display components and articles can be mounted.

SUMMARY OF THE INVENTION

These and other objects are accomplished by universal mounting means for use with display fixtures having cooperating vertically aligned openings for retaining display components comprising hook means for insertion into a slot of a display fixture, leveling means located below said hook means for contact with the display fixture at a point below said slot into which said hook means is inserted and lateral adjustment means for adapting the mounting means to the lateral width between corresponding slots.

The mounting means additionally includes engagement means for attachment of a display component such as a shelf, bar, promotional display, etc.

The thickness of the hook means is thin enough so that it can fit into thin slots (i.e. as used with display fixtures made by HANDY and CHILDS). The width of the hook means is such that it is insertable into slots which are of lesser height (i.e. as used with display fixtures made by LOZIER, SCHULTZ and/or MADIX). Moreover, the height of the hook means is such that adequate contact is made with the interior of the vertical post and so that the hook can be inserted within the various slots.

The thickness of the material used for the vertical posts of the display fixture is adapted for with the leveling means, preferably comprising a threaded post which passes through a threaded opening below the hook means, terminating in a foot member which rests against the display fixture and preferably the vertical post of the display fixture. Of course, the farther the distance between the hook means and the leveling foot the greater weight can be carried.

For additional strength, the hook member further comprises a coined or standing rib on the hook member. Of course, when a rib is used, the width of the hook member including the rib must be taken into account to fit within the slots having the smallest widths.

BRIEF DESCRIPTION OF THE DRAWINGS

The following drawing figures, in which like numbers represent like parts, are intended only to illustrated the invention without limiting it in any manner whatsoever.

DETAILED DESCRIPTION OF THE PREFERRED EMBODIMENT

In its preferred embodiment, the present invention comprises universal mounting means which engage the vertical posts or columns of a gondola display fixture to support a display component such as a shelf, bar, promotional article or the like on which merchandise or promotional means can be stacked, hung or supported for display. The mounting means comprises hook means for insertion into and engagement with slots in the vertical posts of the fixture, leveling means for adjustment of the component being supported to a level, or desired position, and lateral adjustment means for slots placed on various lateral portions of the vertical posts.

Figure 1:
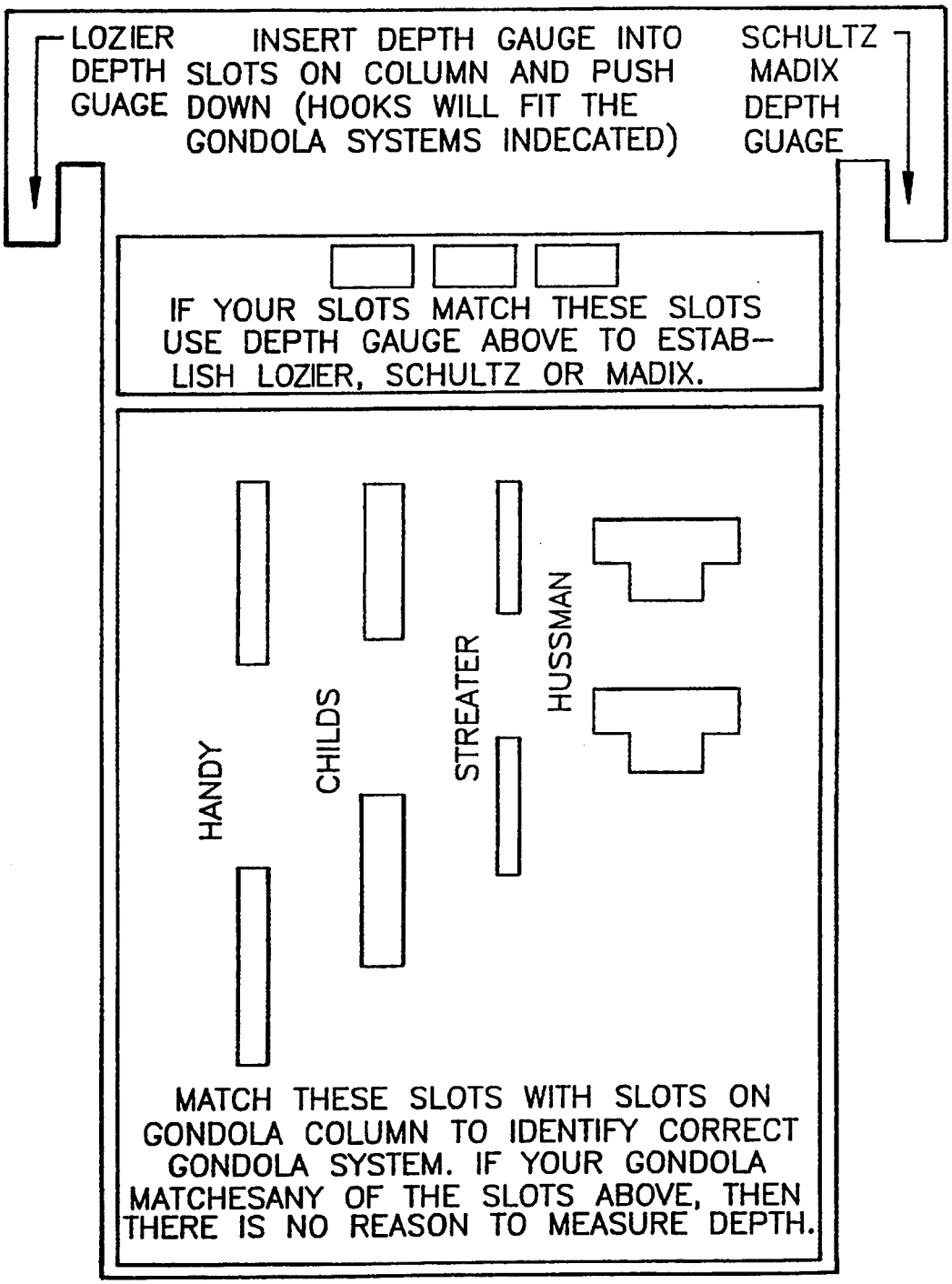
(PRIOR ART) FIG. 1
FIG. 1 is a template used in the prior art to determine the fixture manufacturer.
Figures 2A, 2B:
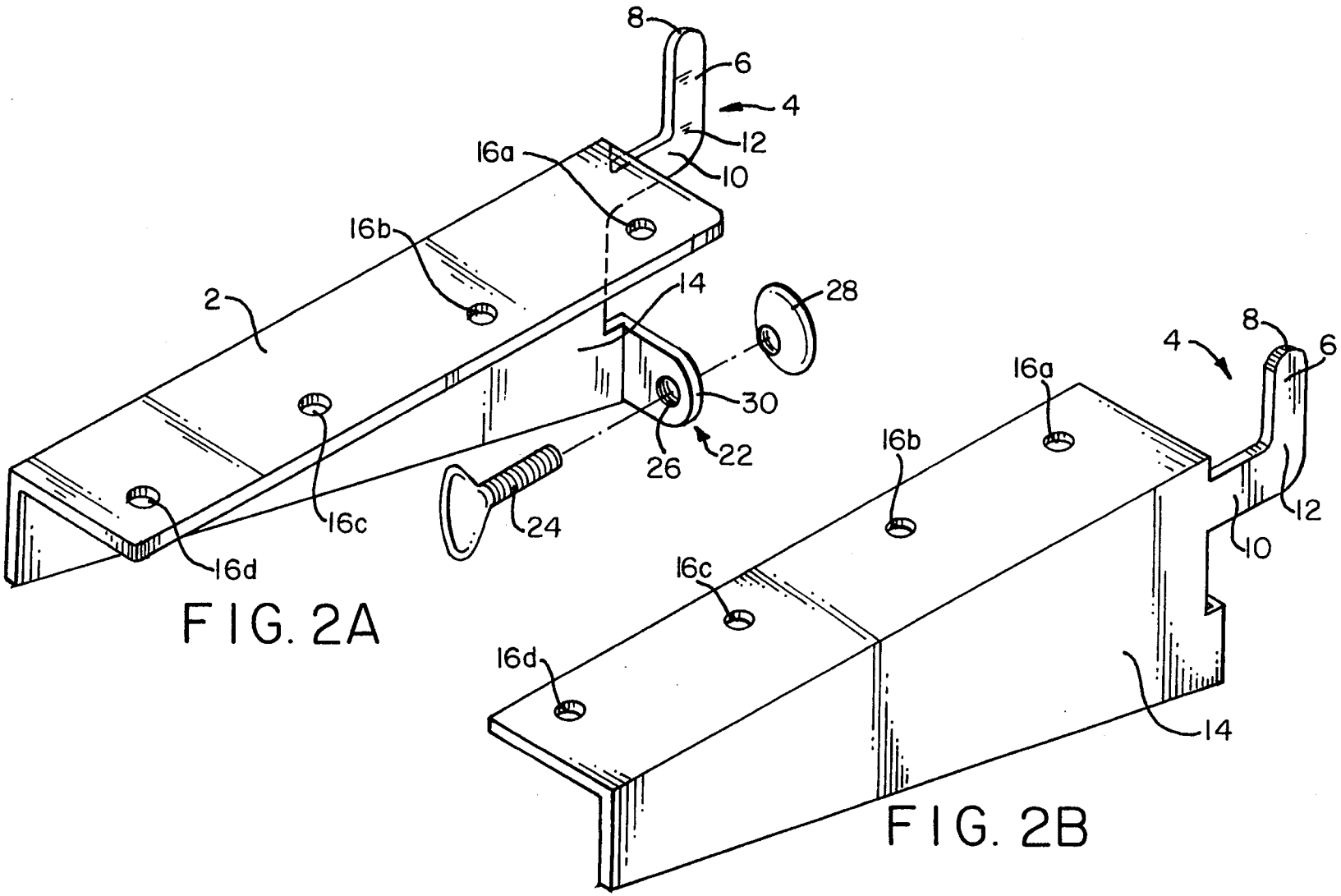
FIG. 2A is a perspective view of the left bracket of an embodiment of the present invention.
FIG. 2B is a perspective view of the right bracket of the embodiment of the present invention shown in FIG. 2A.

As best seen in FIGS. 2A and 2B, the preferred mounting means includes brackets 2 on which the hook member 4 is formed, said hook member 4 having a vertical prong 6 connected to a horizontal section 10, said prong 6 having a terminal end 8 and a fixed end 12. The horizontal section 10 is attached to the bracket body 14.

To accommodate the various slots in the various display fixture posts, the hook member 4 must be thin enough to fit into the thinner slots, such as the slot in a STORE RITE fixture which has a thickness of 0.120". As such, hook member 4, including prong 6 and horizontal section 8, has a preferred thickness of 0.118".

Also, it is preferred to use a rib 7, such as a coined or a standing rib, on at least a portion of the hook member 4 to provide added strength. However, it is understood that the thickness of the hook member 4 includes the rib 7, if used, to fit within the opening of the slot.

Moreover, the width of the prong 6 and the height of the horizontal section 10 must be less than the height of the slot to allow for complete insertion of the hook member 4 into the slot. In its preferred embodiment the width of the prong 6 and height of the horizontal section is 0.4" or less to fit into a ½" high slot, such as manufactured by STORE RITE.

Figures 3A, 3B:
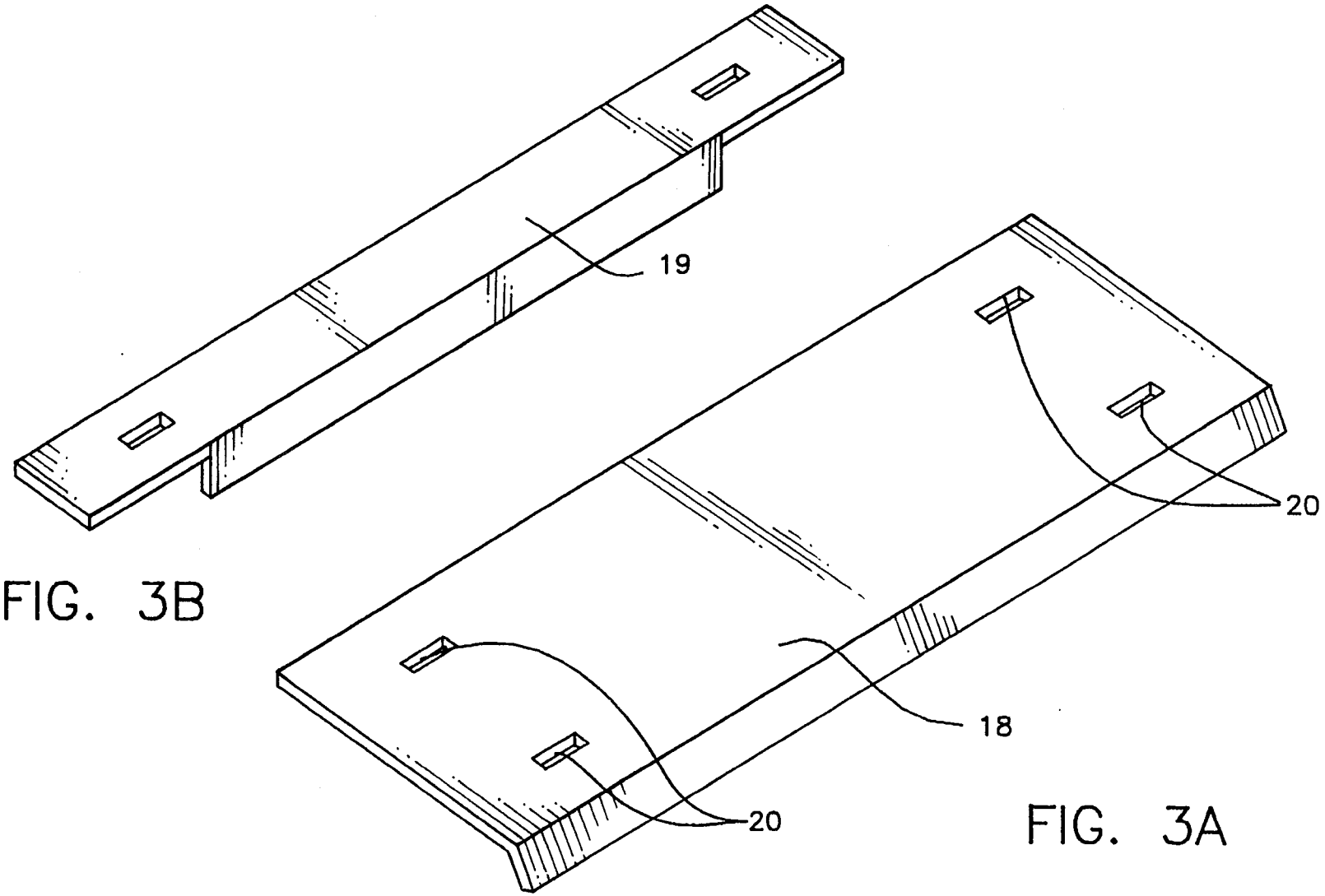
FIG. 3A is a shelf mountable between the brackets shown in FIGS. 2A and 2B, on the first and third holes of the brackets.
FIG. 3B is a spacer for behind the shelf of FIG. 3A when the shelf is mounted on the second and forth holes of the brackets of FIGS. 2A and 2B, to be mounted on the first hole of the brackets.

In the present embodiment, engagement means for engagement of a display component are shown as holes 16 placed in the bracket body 14 and a shelf 18, such as shown in FIG. 3B. Attachment means, preferably ¼" bolts (not shown), pass through said holes 16 in the bracket 2, and elongated holes 20 in the shelf 18, to fasten the shelf 18 to the bracket 2. Four holes 16 are preferred on each bracket so that the shelf can be 8" deep, attachment being at the first and third holes **16*a* and 16*c*, or 10" deep, attachment being at the second and fourth holes 16*b* and 16*d*. A filler shelf 19 can be used to create a 10" shelf, if desired, as shown in FIG. 3B by attachment to holes 16*a***.

In the present embodiment, the shelves 18 have elongated holes 20 to accommodate display fixtures which have slots at different lateral portions of the vertical posts or columns. The elongated holes 20 allow the bolts to be fastened at the proper lateral alignment.

For example, several display fixtures have the slots along the outer portion of the vertical columns. Therefore, the brackets 2 are placed farther apart from each other. To compensate, the present invention utilizes elongated holes 20 in the shelf 18, or alternatively elongated holes 16 in the bracket 2 (not shown), to allow attachment to the shelf toward the outer portion of the elongated holes 20.

Additionally, the brackets 2 include leveling means 22 to compensate for vertical posts or columns having material of different thickness. The preferred leveling means 22 includes a threaded shaft 24 which passes through a threaded opening 26 and a contact foot 28. The threaded hole 26 is preferably placed on a support plate 30 which is at least 9/16" behind the inside edge of the prong 6 to allow the hook 4 to fully engage the slot.

For ease of adjustment, the leveling means 22 preferably has a straight, phillips, allen, wing or textured head at the end of the shaft 24 opposite the foot 28. Most preferred, however, the foot 28 itself has a textured edge, i.e. a foot in the form of a hexagon, so that it can be manipulated to turn the threaded shaft 24 to the designed extension. Preferably the threaded shaft 24 is a threaded ¼" shaft having at least ¾" of usable thread for extension. The preferred foot 28 is ¾" in diameter and ⅛" thick, having a flat contacting face.

Figure 4A:
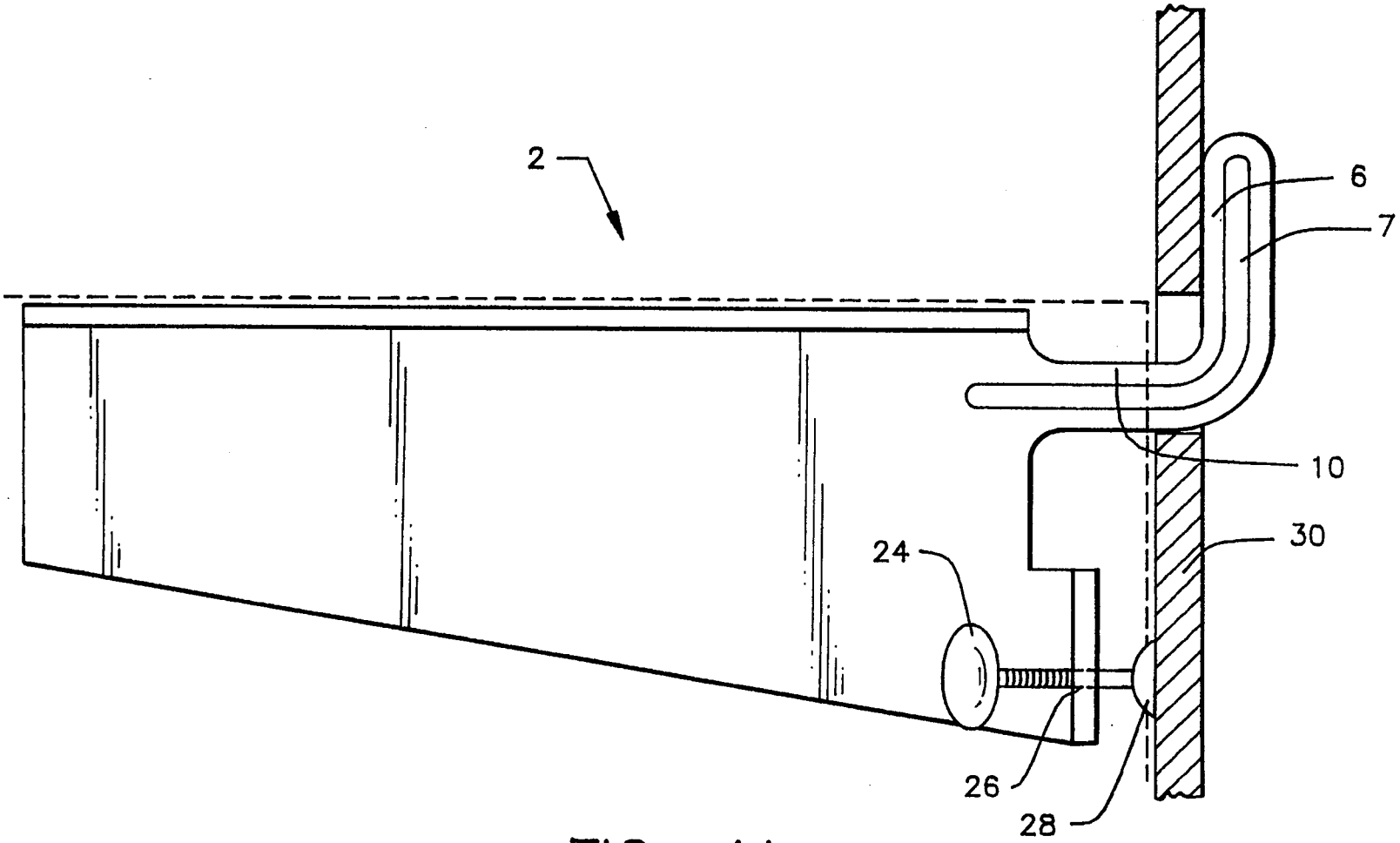
FIG. 4A is a side elevational view of the bracket of FIG. 2A in its mounted configuration on a thick-walled vertical post with a tall slot.
Figure 4B:
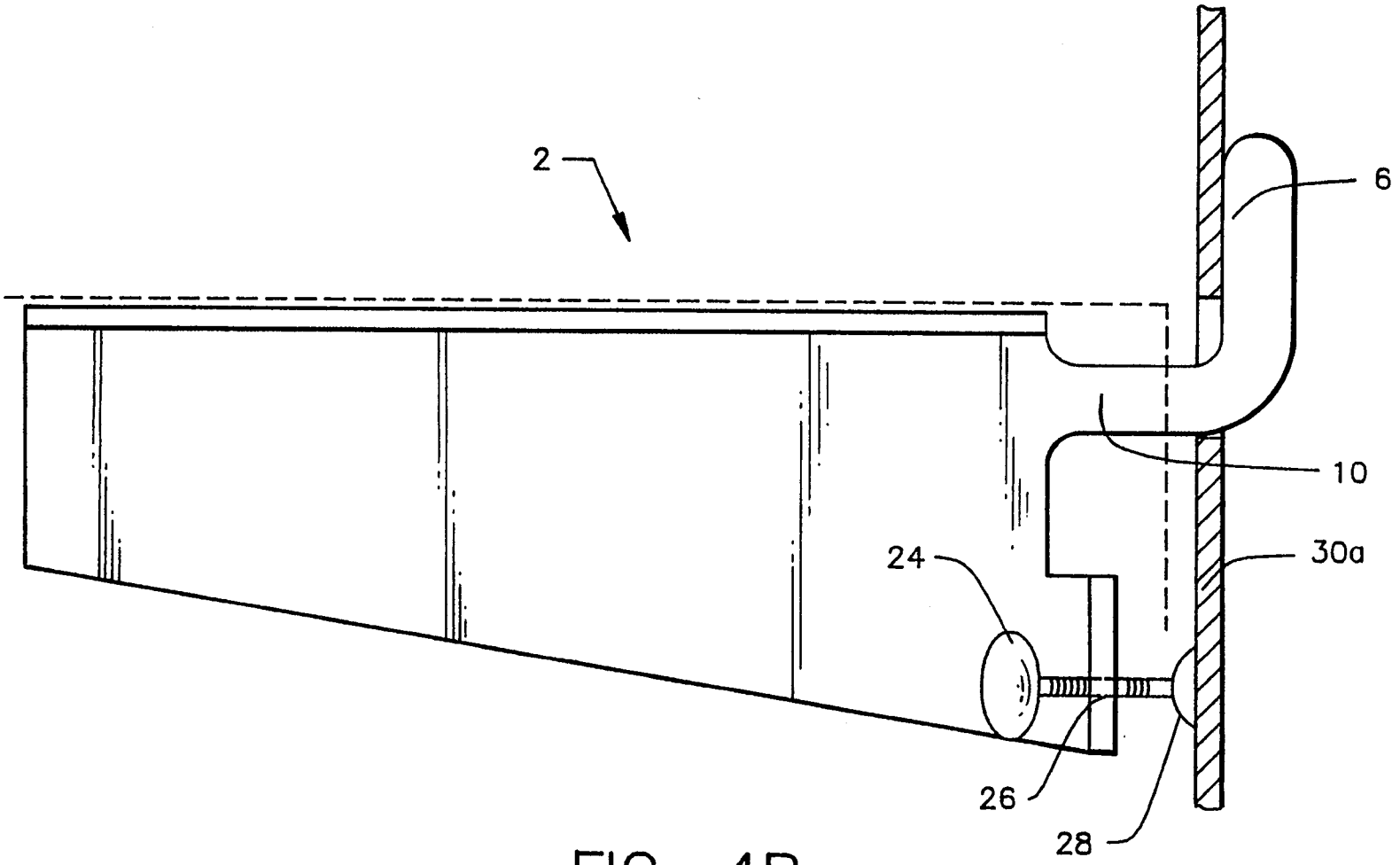
FIG. 4B is a side elevational view of the bracket of FIG. 2A in its mounted configuration on a thin-walled vertical post with a short slot.

As can be seen in FIG. 4A, when the bracket is mounted on a display fixture having a vertical post of a thicker material, such as sold by LOZIER, having a vertical post wall of 0.2" thick, the leveling means is in a retracted position. In FIG. 4B, however, illustrating the STORE RITE display fixture having a vertical post wall thickness of about 0.08", the leveling means 22 is in its extended position.

The preferred bracket 2 is made of sheet steel, preferably 1/16–3/32" thick, which is cut to the outline and bent to create the bracket 2.

Figure 5:
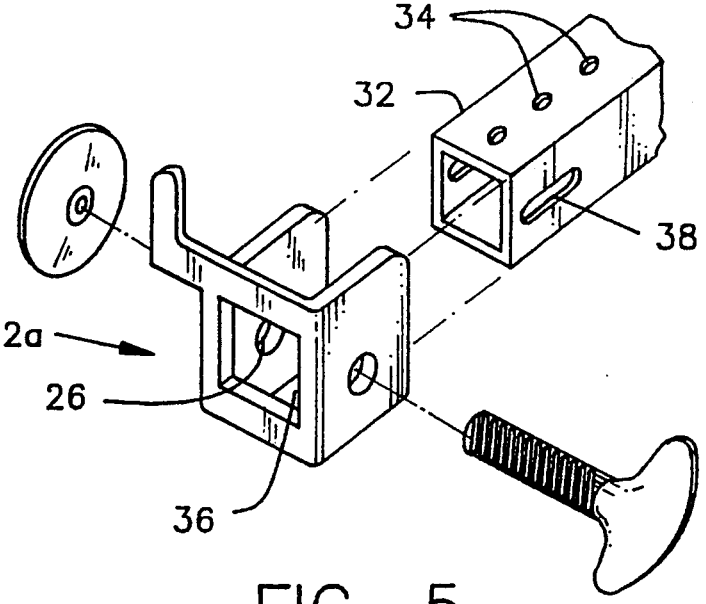
FIG. 5 is an exploded view of an alternate embodiment of the present invention.
Figure 6:
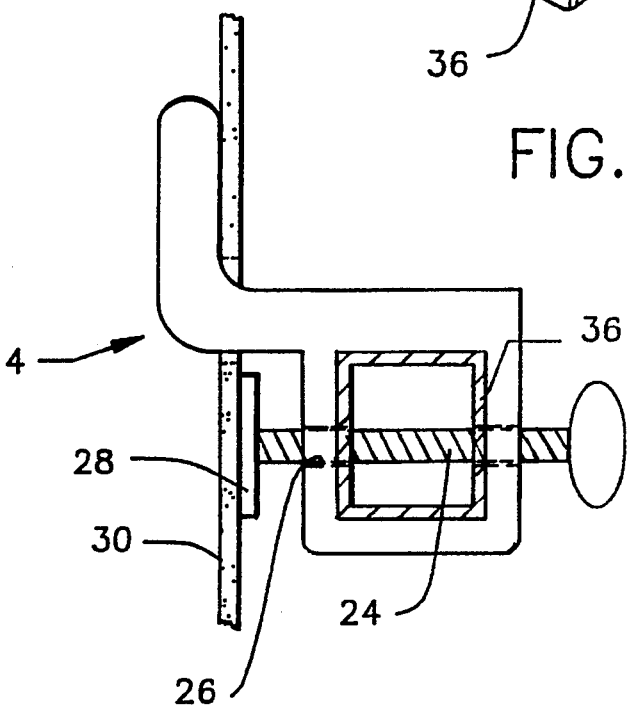
FIG. 6 is a elevational view of the bracket shown in FIG. 5 in its mounted configuration.
Figure 7:
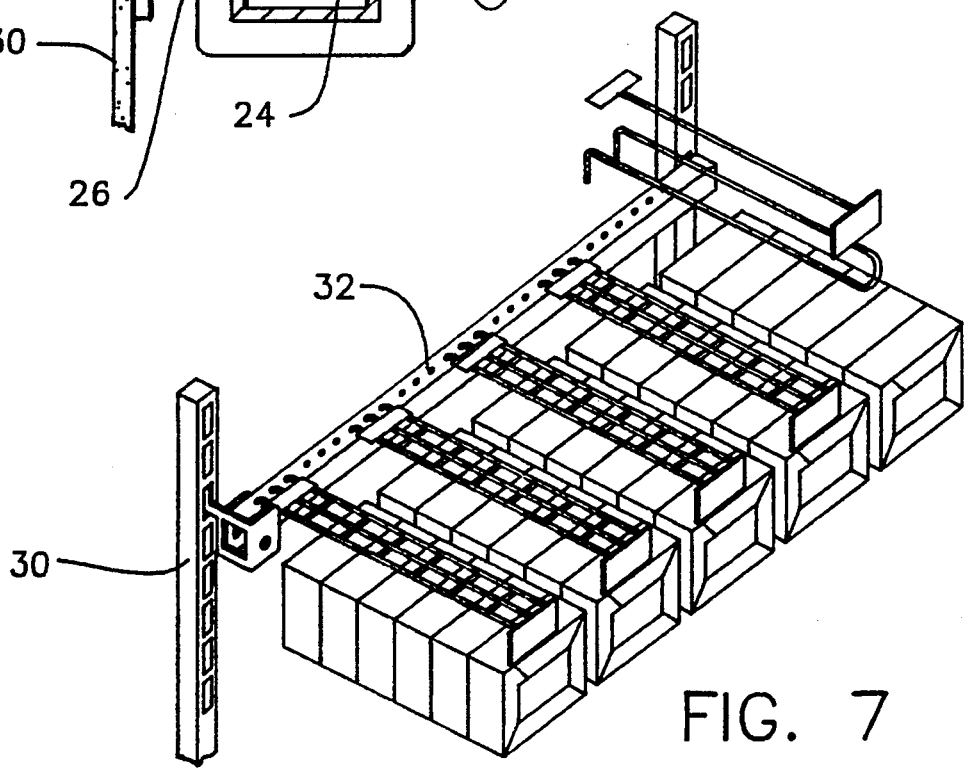
FIG. 7 is a perspective view of the embodiment of FIG. 5 in its operating environment.

In an alternative embodiment, shown in FIGS. 5–7, the same material is configured into a bracket **2*a* to accept a display component comprising steel bar 32 having holes 34** to accept display hooks or the like.

The bracket **2*a* similarly includes a hook member 4 and leveling means 22 as described above. However, for engagement of the display component the bracket has an aperture 36 into which the bar 32 is inserted. The bar 32 is preferably a one inch (1") square bar which is insertable into aperture 36 on bracket 2*a* enabling the threaded shaft 24 of the leveling means 22 to align with an elongated hole 38 in the end of the bar 32. When using a one inch (1") square bar 32, the aperture 36 on the bracket 2*a* is preferably one and one-thirty second inches (1 1/32") square. Thus, when the brackets 2 are inserted and the bar 32 is placed therein, the leveling means 22** locks the assembly in place.

Obvious variations of the above will be apparent to one skilled in the art. For instance, the lateral adjustment means can include elongated holes on the bracket rather than on the component or could comprise a shelf, or the like, which is adjustable laterally in the middle thereof so that no elongated holes are needed at the bracket or on the ends of the shelf. Similarly, the leveling means can comprise a ratchet mechanism rather than a screw-type adjustment. All such variations are intended to be covered by the present invention, limited only by the allowed claims.

We claim:

1. A universal mounting assembly for use with display fixtures having corresponding vertical posts with corresponding forward facing external surfaces having corresponding slots therein, said mounting assembly comprising a display component and bracket means, wherein said bracket means comprises at least one bracket comprising a single hook for insertion into a single slot in the vertical post of the display fixture, adjustable leveling means located below said single hook having contact means for contact with the forward facing external surface of the vertical post of the display fixture and engagement means for engagement of said display component.

2. The assembly of claim 1 further comprising attachment means for attachment of the display component and the bracket, said attachment means comprising lateral adjustment means for adjustment to the lateral distance between corresponding vertical slots of the display fixture.

3. The assembly of claim 2 wherein the lateral adjustment means comprises slotted apertures associated with the engagement means of the bracket, said attachment means further comprising an attachment member which passes through said slotted apertures.

4. The assembly of claim 2 wherein the lateral adjustment means comprises slotted apertures associated with the display component, said attachment means further comprising an attachment member which passes through said slotted apertures.

5. The assembly of claim 1 wherein the engagement means includes multiple means to accommodate engagement of the display component at different locations.

6. The assembly of claim 5 wherein the display component comprises a plurality of sections.

7. The assembly of claim 1 wherein the hook further comprises a strengthening member.

8. The assembly of claim 7 wherein the strengthening member comprises a rib.

9. The assembly of claim 8 wherein the rib is taken from the group consisting of a coined rib and a standing rib.

10. The assembly of claim 1 wherein the hook has a thickness of about 0.118 inches.

11. The assembly of claim 1 wherein the hook comprises a vertical prong and a horizontal section, and further wherein the width of the vertical prong and the height of the horizontal section are each about 0.4 inches.

12. The assembly of claim 11 wherein the horizontal section extends from a bracket body to an inside edge of the vertical prong for a distance of at least 9/16 inches.

13. The assembly of claim 1 wherein the adjustable leveling means comprises a contact means and adjustment means for extending or retracting said contact means.

14. The assembly of claim 13 wherein the contact means comprises a contact foot.

15. The assembly of claim 14 wherein the contact foot is hexagonal, about $\frac{3}{4}$ inches across and about $\frac{1}{8}$ inches thick.

16. The assembly of claim 13 wherein the adjustment means comprises a threaded shaft which engages a threaded hole on a support plate of the bracket and terminates at said contact means.

17. The assembly of claim 16 wherein the threaded shaft comprises rotation means at the end opposite the contact means, said rotation means being taken from the group consisting of a phillips opening, a straight opening an allen head opening, a textured exterior end and a wing nut.

18. The assembly of claim 1 wherein the bracket is comprised of sheet steel from 1/16 to 3/32 inches thick.

19. The assembly of claim 1 wherein the engagement means for engaging said display component is an aperture in the bracket through which at least a portion of said display component passes.

20. The assembly of claim 19 wherein the display component comprises a steel bar having elongated slots at each end through which at least a portion of said adjustable leveling means passes.

21. A mounting bracket for use with display fixtures having a forward facing external surface and vertically arranged slots therein, said bracket comprising a single hook for insertion into one of said slots, adjustable leveling means comprising contact means for contact with the forward facing external surface located below said hook and engagement means for engagement of a desired item.

22. The mounting bracket of claim 21 wherein the leveling means further comprises adjustment means.

23. The device of claim 22 wherein the adjustment means comprises a threaded shaft terminating at said contact means at one end and engaging a threaded hole in said bracket for extending and retracting said contact means in relation to said hook means.

* * * * *